US009194099B2

(12) United States Patent
Shea et al.

(10) Patent No.: US 9,194,099 B2
(45) Date of Patent: Nov. 24, 2015

(54) AUGMENTED HYDRAULIC THUMB KINEMATIC MEMBER LENGTH

(71) Applicant: Caterpillar Inc., Peoria, IL (US)

(72) Inventors: Ryan Patrick Shea, Manhattan, KS (US); Aaron Dean Kovar, Topeka, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/772,130

(22) Filed: Feb. 20, 2013

(65) Prior Publication Data

US 2014/0230291 A1 Aug. 21, 2014

(51) Int. Cl.
*E02F 3/40* (2006.01)
*E02F 9/22* (2006.01)

(52) U.S. Cl.
CPC ..... *E02F 3/404* (2013.01); *E02F 9/2271* (2013.01)

(58) Field of Classification Search
CPC ..... E02F 3/369; E02F 3/3604; E02F 3/404; E02F 3/413; E02F 3/4135
USPC ..... 37/406
See application file for complete search history.

(56) References Cited

U.S. PATENT DOCUMENTS

| | | | | |
|---|---|---|---|---|
| 5,167,182 | A | 12/1992 | Sims | |
| 6,450,081 | B1 * | 9/2002 | Sorbel | 91/443 |
| 6,742,291 | B2 * | 6/2004 | Frigon et al. | 37/406 |
| 7,165,930 | B2 * | 1/2007 | Pisco | 414/729 |
| 7,818,901 | B2 * | 10/2010 | Zeno et al. | 37/406 |
| 8,827,626 | B2 * | 9/2014 | Seljestad | 414/724 |
| 2003/0012597 | A1 * | 1/2003 | Miller et al. | 403/322.2 |
| 2004/0261301 | A1 * | 12/2004 | Vering et al. | 37/403 |
| 2005/0042025 | A1 * | 2/2005 | Miller et al. | 403/322.2 |
| 2005/0188568 | A1 * | 9/2005 | Clapper, Jr. | 37/406 |
| 2013/0115038 | A1 * | 5/2013 | Bargellini et al. | 414/724 |
| 2014/0007467 | A1 * | 1/2014 | Kovar et al. | 37/406 |
| 2014/0230587 | A1 * | 8/2014 | Shea et al. | 74/103 |

FOREIGN PATENT DOCUMENTS

DE 102006031365 1/2008

* cited by examiner

*Primary Examiner* — Gary Hartmann

(74) *Attorney, Agent, or Firm* — Miller, Matthias & Hull LLP

(57) ABSTRACT

An implement system for a machine having a stick member with a nose end and a mounting bracket is disclosed. The implement system includes a thumb pivotally connected to the nose end of the stick member, and a thumb actuator operatively connected between the mounting bracket of the stick member and the thumb to move the thumb between a fully retracted position and a fully extended position. The implement system has one or more of an RTK Factor, a TP Ratio and an ITO Ratio having values within ranges that allow installation of the implement system with the thumb actuator connected the thumb either directly or by a linkage assembly without changing the position of the mounting bracket on the stick member.

17 Claims, 6 Drawing Sheets

300

| Thumb Assembly | TS Ratio (BT/CS) | RTK Factor ($B^{2.2}/BT*P$) ($mm^{0.2}$) | TP Ratio (BT/P) | ITO Ratio (BT/B) |
|---|---|---|---|---|
| New Thumb 1 | 2.1 | 25.3 | 3.6 | 0.81 |
| New Thumb 2 | 2.1 | 24.9 | 3.5 | 0.81 |
| New Thumb 3 | 2.1 | 25.8 | 3.6 | 0.81 |
| New Thumb 4 | 1.9 | 24.3 | 3.3 | 0.79 |
| New Thumb 5 | 1.9 | 25.2 | 3.4 | 0.80 |

FIG.6

AUGMENTED HYDRAULIC THUMB KINEMATIC MEMBER LENGTH

TECHNICAL FIELD

This disclosure relates generally to excavator machines having articulating ground-engaging implements and counteracting thumbs and, in particular, to kinematic ratios and factors balancing thumb rotation and leverage with packaging constraints of link and no-link thumbs and the excavator machines.

BACKGROUND

Earthmoving machines, for example excavating equipment, are commonly used to move large amounts of earth, rocks or other work materials. Excavators, including backhoes and other types of excavating equipment, include a boom member extending from and pivotally connected to a main body of the machine. Further, a stick member is pivotally connected to the boom member opposite the connection to the main body, and an implement, often a bucket, is pivotally attached to a nose end of the stick member. While these types of excavators are well suited for moving loose dirt and small rocks, the buckets are not as well suited for picking up larger objects that do not fit easily into the bucket. Excavators may be fitted with an additional attachment, such as a fixed or movable thumb, that opposes the movement of the implement and facilitates grabbing and moving rocks, pipes, concrete, trees, and other larger awkward objects.

The movable thumbs are manipulated by an actuation mechanism such as a hydraulic cylinder and accompanying control valve. The cylinder of the mechanism is connected between the thumb and a bracket provided on the stick member. The cylinder may have an end connected to the thumb directly (no-link type thumb), or may be connected indirectly by a linkage (link-type thumb) for greater range of thumb rotation. In previously known machines, the stick member typically requires different bracket locations for a link-type thumb and a no-link type thumb. Dealers or operators may need to weld brackets on the stick member at the work location separately for the link-type thumb and the no-link type thumb since each type requires the bracket to be placed in a different location. Configuring machines with brackets for both link-type and no-link type thumbs is not economically practical. On-location welding of the brackets to the stick member may reduce the life of the stick member which has been post-weld stress-relieved at the machine factory. To overcome the problem set forth above, one solution is to modify the design of the no-link cylinder to allow for a consistent bracket location on the stick member for the link-type thumb and the no-link type thumb. U.S. Pat. No. 5,167,182 to Sims discloses a fluid actuator assembly comprising a plurality of modules that are secured in serial relation to form a body of the fluid actuator such that the length of the actuator may be varied. However, the reference does not suggest implementation of the fluid actuator assembly to drive a movable thumb.

In addition to cylinder length considerations, adaptation of the stick member to accommodate both link-type and no-link type thumbs with a single mounting bracket position creates issues with ensuring that both thumb types perform adequately in cooperation with the implement. Both thumb types must have the thumb rotation required to grasp work material that will be moved by the machine, and must impart sufficient force to engage and retain the work material. At the same time, the thumbs must be capable of retracting to a stowed position where the thumbs will not interfere in the operation of the implement when the thumbs are not in use. For these reasons, a need exists for implement assemblies having a single point of attachment for both link-type and no-link type thumb assemblies as well as for criteria for designing and evaluating designs of thumb and stick member arrangements that will provide acceptable performance with both link-type and no-link type thumb assemblies.

SUMMARY OF THE DISCLOSURE

In one aspect of the present disclosure, an implement system for a machine having a stick member with a nose end and a mounting bracket is disclosed. The implement system includes a thumb pivotally connected to the nose end of the stick member, and a thumb actuator operatively connected between the mounting bracket of the stick member and the thumb to move the thumb between a fully retracted position and a fully extended position, wherein the implement system has an RTK Factor with a value within a range having a lower limit of approximately 24.0 and an upper limit of approximately 28.0.

In another aspect of the present disclosure, an implement system for a machine having a stick member with a nose end and a mounting bracket is disclosed. The implement system includes a thumb pivotally connected to the nose end of the stick member, and a thumb actuator operatively connected between the mounting bracket of the stick member and the thumb to move the thumb between a fully retracted position and a fully extended position, wherein the implement system has a TP Ratio with a value greater than 3.0.

In a further aspect of the present disclosure, an implement system for a machine having a stick member with a nose end and a mounting bracket is disclosed. The implement system includes a thumb pivotally connected to the nose end of the stick member, and a thumb actuator operatively connected between the mounting bracket of the stick member and the thumb to move the thumb between a fully retracted position and a fully extended position, wherein the implement system has an ITO Ratio with a value greater than 0.78.

Additional aspects are defined by the claims of this patent.

BRIEF DESCRIPTION OF THE DRAWINGS

FIG. 6 is a chart including design parameter values for thumb assemblies in accordance with the present disclosure.

DETAILED DESCRIPTION

Although the following text sets forth a detailed description of numerous different embodiments of the present disclosure, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
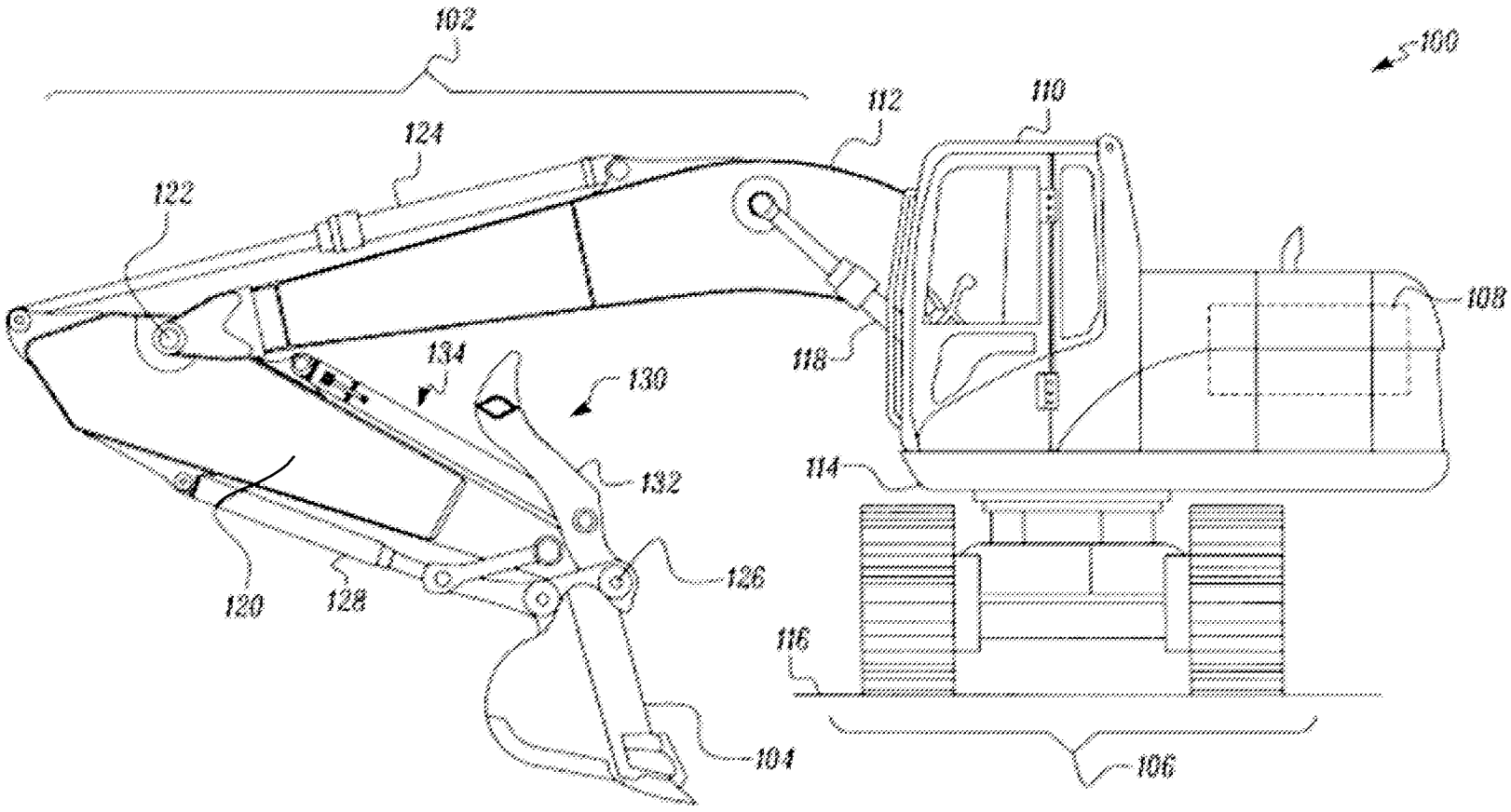
FIG. 1 is a side elevation view of a machine having an articulating ground-engaging implement and a counteracting no-link type thumb assembly in accordance with the present disclosure.

FIG. 1 illustrates a side view of a machine 100, such as a hydraulic excavator, in which various embodiments of the present disclosure may be implemented. The machine 100 may include an implement system 102 configured to move an implement 104, such as a bucket, a drive system 106 for propelling the machine 100, a power source 108 that provides power to the implement system 102 and the drive system 106, and an operator station 110 to control the movement of the implement 104 and the machine 100.

As illustrated in FIG. 1, the implement system 102 may include a boom member 112 pivotally connected at a first end to a frame 114 of the machine 100 by a first pivot pin (not shown) and configured to pivot in a vertical plane about a first horizontal axis relative to a ground 116 by a pair of first hydraulic actuators 118 (only one side shown in FIG. 1). The implement system 102 may also include a stick member 120 pivotally connected to the boom member 112 at a second end by a second pivot pin 122 and configured to pivot in the vertical plane about a second horizontal axis by a second hydraulic actuator 124. Further, the implement 104 is pivotally connected to the stick member 120 opposite the boom member 112 at a nose end of the stick member 120 by a nose pin 126, and configured to pivot in the vertical plane about a third horizontal axis by a third hydraulic actuator 128. In alternative embodiments, the implement 104 may be connected to the nose end of the stick member 120 by a coupling mechanism, such as a pin grabber coupler.

According to an embodiment, the implement system 102 further includes a no-link type thumb assembly 130. The no-link type thumb assembly 130 may include a thumb 132 pivotally connected to the stick member 120 by the nose pin 126 and also configured to pivot in the vertical plane about the third horizontal axis by a thumb actuator 134. The power source 108 may embody an engine such as, for example, a diesel engine, a gasoline engine, a gaseous fuel-powered engine, or any other type of combustion engine known in the art. It is contemplated that the power source 108 may alternatively embody a non-combustion source of power such as a fuel cell, a power storage device, or another source known in the art. The power source 108 may produce a mechanical or electrical power output that may be used to pressurize a hydraulic fluid distributed by corresponding control valves for extending and retracting the hydraulic actuators 118, 124, 128 and 134.

Figure 2:
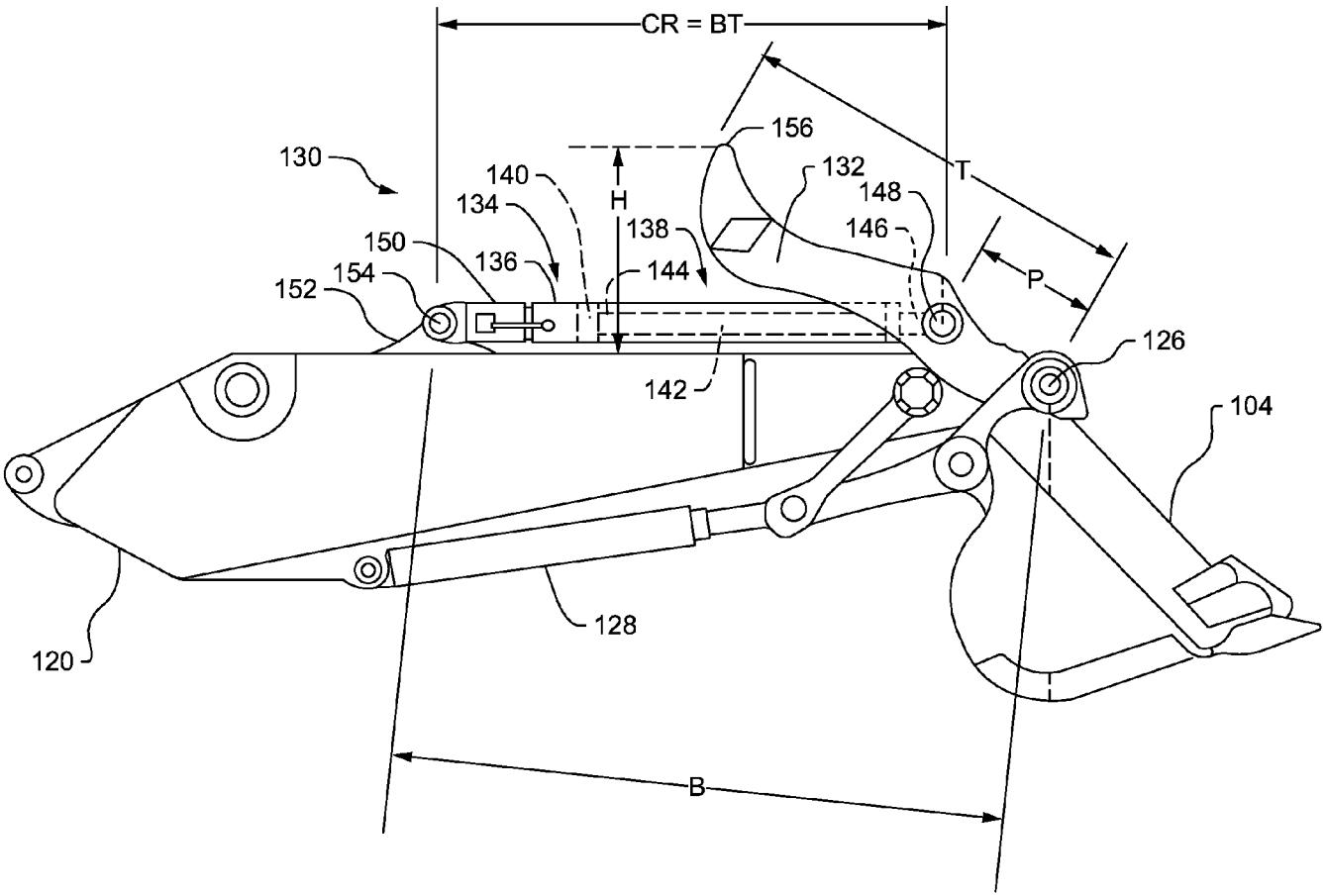
FIG. 2 is a side view of the stick member and no-link type thumb assembly of the machine of FIG. 1 with the counteracting thumb in a fully retracted position.

FIG. 2 illustrates a side view of the stick member 120 and the no-link type thumb assembly 130 with the thumb actuator 134 in a retracted position. According to an embodiment, the thumb actuator 134 includes a cylinder body 136 and a piston assembly 138. The piston assembly 138 may include a piston 140 and a piston rod 142 (shown in dashed lines) such that the piston 140 and a proximal end 144 of the piston rod 142 are disposed within the cylinder body 136 and a distal end 146 of the piston rod 142 is pivotally connected to the thumb 132 by a thumb power pin 148. An end 150 of the cylinder body 136 opposite the piston assembly 138 is pivotally connected to the stick member 120 by a mounting bracket 152 via a bracket pin 154. The mounting bracket 152 may be welded, bolted or otherwise affixed to the surface of the stick member 120, or may be formed integrally with the stick member 120.

FIG. 2 further illustrates various dimensions of the thumb assembly 130 that are relevant to determining configurations of the no-link type thumb assembly 130 that facilitate installation of link-type thumb assemblies without changing the position of the mounting bracket 152 on the stick member 120. The thumb 132 may have a thumb length or thumb radius T that is equal to the distance from a central axis of the nose pin 126 to a thumb tip 156. The distance from the central axis of the nose pin 126 to the central axis of the thumb power pin 148 may be equal to a thumb power radius or thumb moment arm P that is acted upon by a force provided by the thumb actuator 134. The position of the mounting bracket 152 on the stick member 120 may be indicated by a bracket positioning length B equal to the distance between the central axis of the nose pin 126 and a central axis of the bracket pin 154. As shown in FIG. 2 with the piston assembly 138 and, correspondingly, the thumb 132 of the thumb assembly 130 in the fully retracted position, the thumb actuator 134 has a cylinder retracted length CR when the thumb 132 is fully racked to the open position. Further, in the fully retracted position, the thumb 132 is stowed at a stow height H with respect to the stick member 120. With the no-link type thumb assembly 130 in the fully retracted position as shown, a retracted bracket pin to thumb power pin length BT from a central axis of the bracket pin 154 to the central axis of the thumb power pin 148 is equal to the cylinder retracted length CR.

Figure 3:
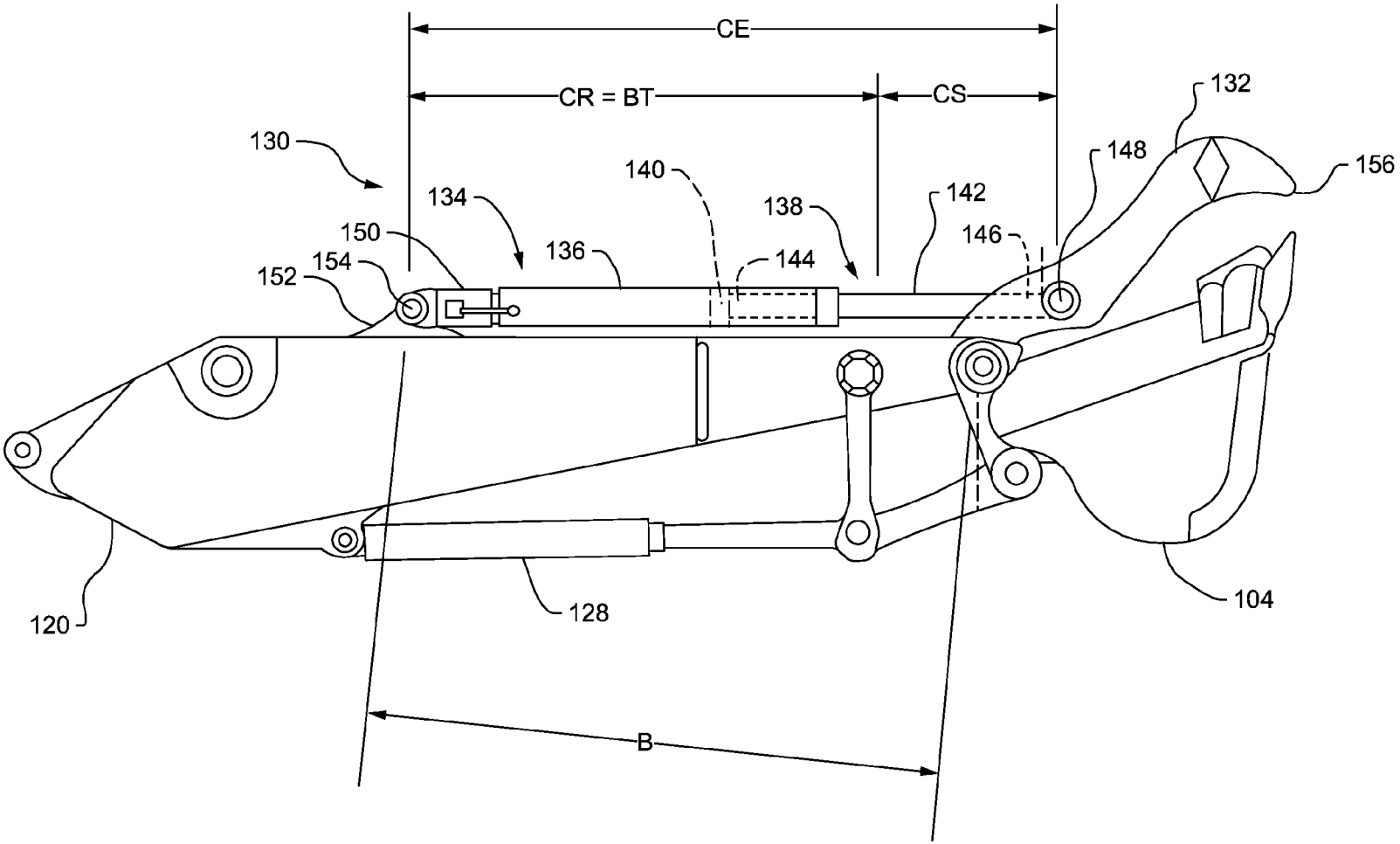
FIG. 3 is a side view of the stick member and no-link type thumb assembly of the machine of FIG. 1 with the counteracting thumb in a fully extended position.

FIG. 3 illustrates a side view of the stick member 120 and the no-link type thumb assembly 130 with the thumb actuator 134 in an extended position wherein the thumb 132 is rotated to a fully extended position proximate the implement 104. Throughout the movement of the thumb assembly 130, the dimensions P, T, B and CR maintain their values as defined above. With the piston rod 142 at the limit of its extension from the cylinder body 136, the thumb power pin 148 is spaced from the bracket pin 154 by a cylinder extended length CE. The difference between the cylinder extended length CE and the cylinder retracted length CR is equal to a cylinder stroke length CS through which the piston 140 and the piston rod 142 moved to rotate the thumb 132 from the fully retracted position of FIG. 2 to the fully extended position of FIG. 3.

Figure 4:
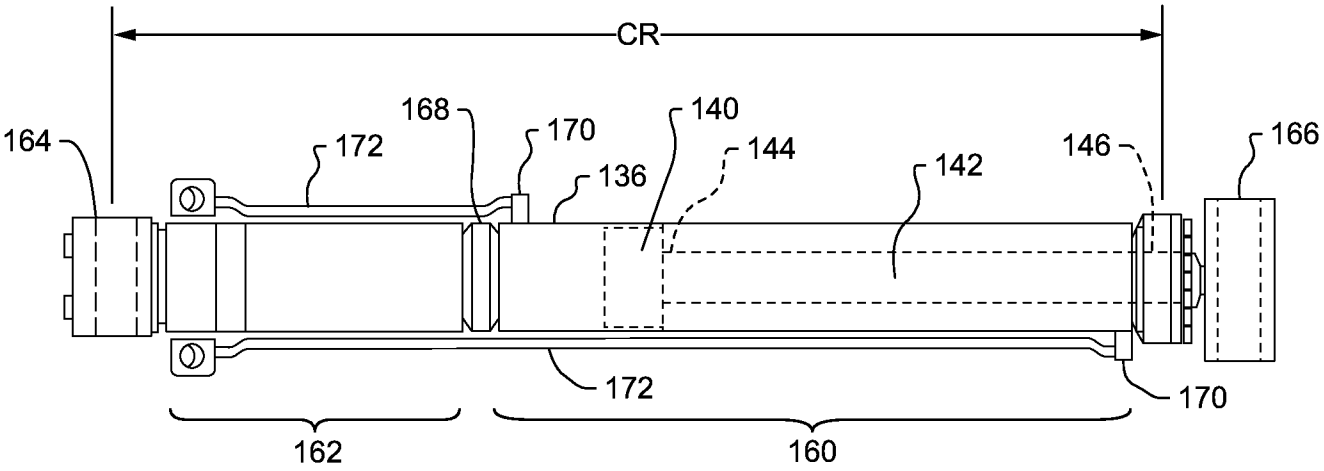
FIG. 4 is a side view of a thumb actuator for a no-link type thumb assembly in accordance with the present disclosure in a retracted position.

FIG. 4 illustrates a side view of the thumb actuator 134 according to an aspect of the present disclosure that allows the no-link type thumb assembly 130 to be installed with the mounting bracket 152 in the same location as for a link-type thumb assembly. The cylinder body 136 of the thumb actuator 134 may include a main portion 160 and an extension portion 162 such that the piston 140 (shown in dashed lines) is configured to reciprocate substantially within the main portion 160. In an aspect, the extension portion 162 may be an unoccupied or empty structure such that the extension portion 162 may increase the cylinder retracted length CR of the thumb actuator 134 corresponding to the retracted position of the thumb actuator 134. Further, a first barrel pin bore 164 is configured receive the bracket pin 154 and interconnect the mounting bracket 152 and the extension portion 162 (see FIGS. 1-3). A second barrel pin bore 166 is configured to receive the thumb power pin 148 and connect the distal end 146 of the piston rod 142 to the thumb 132. An end plate 168, for example a solid plate, may be configured to interconnect the extension portion 162 and the main portion 160 of the cylinder body 136. Further, the cylinder body 136 may include ports 170 at each end of the main portion 160 and configured to supply a hydraulic fluid for both the retraction and extension of the piston 140. The ports 170 may further be connected to hydraulic tubes 172 providing pressurized hydraulic fluid from a control valve (not shown) and traversing the main portion 160 and the extension portion 162, and terminating close to the first barrel pin bore 164 to minimize rotational movement of hydraulic hoses and fittings during normal operation. As can be seen in FIG. 4, the cylinder retracted length CR is equal to the distance between a central axis of the first barrel pin bore 164 and a central axis of the second barrel pin bore 166 when the piston rod 142 is fully retracted, and the cylinder extended length CE is equal to the distance between the central axes of the pin bores 164, 166 when the piston rod 142 is fully extended. The cylinder stroke length CS is equal to the difference between the cylinder extended length CE and the cylinder retracted length CR.

Figure 5:
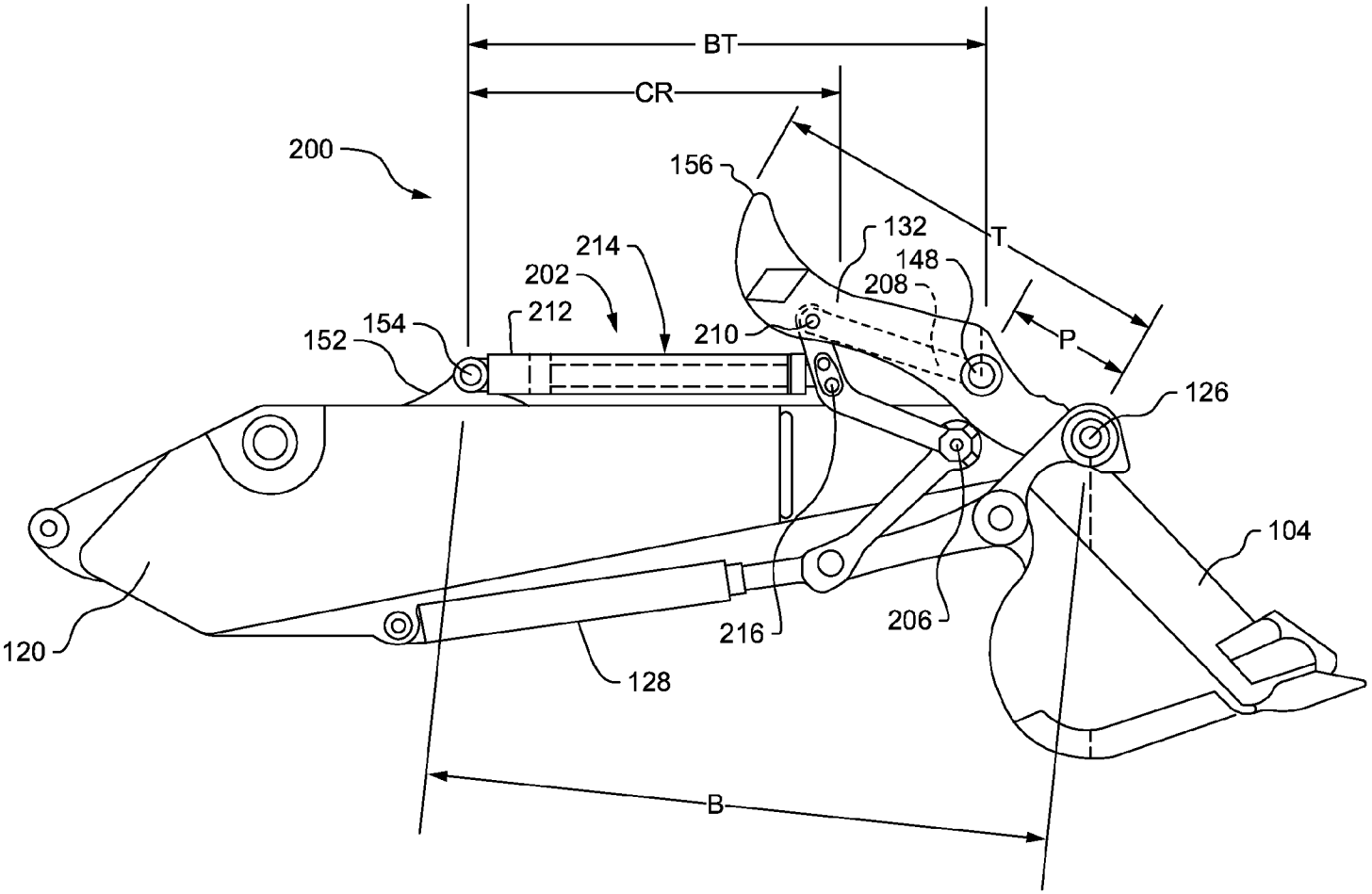
FIG. 5 is a side view of the stick member of the machine of FIG. 1 with a counteracting link-type thumb assembly in a fully retracted position.

FIG. 5 illustrates a side view of the machine 100 with a link-type thumb assembly 200 that is pivotally connected to the stick member 120 and manipulated by a thumb actuator 202. The link-type thumb assembly 200 may include a first link member or idler link 204 pivotally connected to the stick member 120 by an idler pivot pin 206. The idler link 204 is further connected to a first end of a second link member or power link 208 by a linkage pivot pin 210. Further, a second end of the power link 208 is pivotally connected to the thumb 132 by the thumb power pin 148. The thumb actuator 202 includes a cylinder body 212 and a piston assembly 214. The piston assembly 214 is pivotally connected to the idler link 204 by a second idler pivot pin 216. The three pinhole configuration of the idler link 204 allows the hockey stick shape of the idler link 204 to get around the nose of the stick member 120 and achieve full rotation of the thumb 132 to the implement 104. Those skilled in the art will understand that a two pinhole configuration may be used with the piston assembly 214 connected to the links 204, 208 at the joint formed by the linkage pivot pin 210 with a reduced range of rotation of the thumb 132.

The cylinder body 212 is pivotally connected to the mounting bracket 152 by the bracket pin 154. In the present disclosure, the mounting bracket 152 is attached to the stick member 120 at the same position with the same bracket positioning length B as with the no-link type thumb assembly 130 as shown in FIGS. 1-3. With the links 204, 208 connecting the thumb actuator 202 to the thumb power pin 148, the thumb actuator 202 is shorter than the thumb actuator 134. For this reason, the cylinder retracted length CR is less than the retracted bracket pin to thumb power pin length BT when the thumb 132 is in the fully retracted position. According to the present design, though, the lengths B, P and BT will be equal for corresponding no-link type thumb assemblies 130 and link-type thumb assemblies 200 when the mounting bracket 152 in the same position on the stick member 120 and the same thumb 132 is installed.

Industrial Applicability

The thumb assemblies 130, 200 in accordance with the present disclosure allow the stick member 120 to be fabricated with the mounting bracket 152 positioned at a location that accommodates installation of either type of thumb assembly 130, 200. The mounting bracket 152 may be preinstalled on or integrally formed with the stick member 120 at the factory so that dealers or operators do not have to weld the mounting bracket 152 onto the stick member 120 at the work location after the thumb assembly type is determined. Elimination of on-location welding of the mounting bracket 152, and removal and re-welding if a change is made to a different thumb assembly 130, 200, reduces stress on the stick member 120 that can ultimately reduce the life of the stick member 120.

Because the position of the mounting bracket 152 is intended for use with both thumb assembly types, the various components of the thumb assemblies 130, 200 should be dimensioned so the thumb 132 is capable of rotating through the desired range of motion and provide sufficient forces for control of the work material being manipulated by the implement 104 and the thumb 132. Since previous designs of implement systems 102 did not contemplate using a single position of the mounting bracket 152 for both types of the thumb assemblies 130, 200, no recognized design parameters exist in the art for determining dimensions for the components of the thumb assemblies 130, 200 that enable the designer to balance the rotation of the thumb 132, the leverage and torque imparted on the thumb 132 by the thumb actuators 134, 202, and the stowed profile and other packaging constraints for the thumb 132. The following discussion outlines various design parameters developed by the inventors for designing the thumb assemblies 130, 200. The design parameters may be used individually or in combination as necessary, and a particular design need not satisfy the ranges of values for all the design parameters except where noted below, if at all.

FIG. 6 presents a chart 300 including design parameter values as described below for a variety of no-link type thumb assemblies 130. The thumb assemblies 130 identified as New Thumb 1 through New Thumb 5 represent no-link thumb designs that are compatible with locations of the mounting bracket 152 primarily defined by corresponding link-type thumb assemblies 200. The values of each of the derived design parameters in chart 300 are dimensionless except as indicated below.

The first design parameter relevant to the design of the thumb assemblies 130 compares the retracted bracket pin to thumb power pin length BT to the cylinder stroke length CS of the thumb actuator 134. The Thumb Stroke (TS) Ratio is defined as follows:

$$TS\ \text{Ratio} = \frac{BT}{CS} \tag{1}$$

As shown in the chart 300, New Thumbs 1-5 have TS Ratios centered on a value of approximately 2.0 and have a range of values with an upper limit of approximately 2.1 and a lower limit of approximately 1.9. Consequently, in designs accommodating both thumb assemblies 130, 200, the cylinder stroke length CS is approximately 50% of the distance between the central axes of the bracket pin 154 and the thumb power pin 148 when the thumb actuator 134 is retracted. For a given retracted bracket pin to thumb power pin length BT, a TS Ratio greater than the upper limit of the range may indicate a shorter cylinder stroke length CS that may not provide full rotation of the thumb 132, and a TS Ratio less than the lower limit of the range may indicate overextension of the piston rod 142 and engagement and binding with the nose of the stick member 120 and/or contact between the cylinder body 136 and the stick member 120.

A second design parameter is indicative of the balance achieved by a configuration of the components of the thumb assembly 130, 200 between the rotation of the thumb 132, the leverage or torque, and the corresponding forces, imparted on the thumb 132 by the thumb actuator 134, 202, and the extent to which the thumb 132 is stowed against the stick member 120 when the thumb actuator 134, 202 is retracted. A Retracted Thumb Kinematic (RTK) Factor considers the bracket positioning length B, the retracted bracket pin to thumb power pin length BT, and the thumb power radius P. The RTK Factor is defined as follows:

$$RTK\ \text{Factor} = \frac{B^{2.2}}{BT * P} \tag{2}$$

where the exponent 2.2 gives the bracket positioning length B an appropriate weighting in the equation (2), and the RTK Factor has units of $mm^{0.2}$. Where the lengths of the components are expressed in inches, the RTK Factor equation becomes:

$$RTK\ \text{Factor} = \frac{1.909707 * B^{2.2}}{BT * P} \tag{2a}$$

where the additional factor 1.909707 has units of $in^{0.2}/mm^{0.2}$. The values of the RTK Factor are within a range having a lower limit of approximately 24.3 $mm^{0.2}$ and an upper limit of approximately 25.8 $mm^{0.2}$ as indicated by the values in chart 300 for the New Thumbs 1-5. However, the range of acceptable values of the RTK Factor for the thumb assemblies 130, 200 in installations where the thumb assembly types are interchangeable can be as broad as 24.0 $mm^{0.2}$-28.0 $mm^{0.2}$.

The impact of varying the retracted bracket pin to thumb power pin length BT and the thumb power radius P can be evaluated using the RTK Factor with the bracket positioning length B being held constant. Increasing values of the length BT decreases the RTK Factor below the lower end of the range of acceptable values and may correspondingly increase the thumb stow height H such that the thumb 132 may interfere with the other components of the implement system 102 when the thumb 132 is fully racked and not in use. Decreasing values of the length BT and corresponding increases in the RTK Factor may indicate that the thumb 132 may not be able to fully rotate to the desired closed position. Decreasing values of the length BT may also cause a larger component of the force created by the thumb actuator 134, especially while in the retracted position, to act along the line connecting the nose pin 126 and the thumb power pin 148, and thereby increase the stresses on the pins 126, 148.

Variation in the thumb power radius P also has effect on the thumb rotation, the thumb stow height H, and the forces applied by the thumb actuator 134 on the pins 126, 148. When the thumb power radius P increases and the RTK Factor decreases, the longer moment arm for the thumb actuator 134 acting on the thumb 132 results in less rotation of the thumb 132 for the same cylinder stroke length CS. Increasing the thumb power radius P also increases the thumb stow height H when the thumb 132 is in the open position. Decreasing the thumb power radius P allows for greater rotation of the thumb 132 for the same stroke length CS that can result in binding of the piston rod 142 against the nose of the stick member 120 and/or creating contact between the cylinder body 136 and the stick member 120. Decreasing the thumb power radius P may also have a similar impact as decreasing the length BT by increasing the stresses applied to the pins 126, 148.

An additional design parameter having utility in designing interchangeable thumb assemblies 130, 200 compares the retracted bracket pin to thumb power pin length BT to the thumb power radius P. The Thumb Performance (TP) Ratio is defined as follows:

$$TP\ \text{Ratio} = \frac{BT}{P} \tag{3}$$

As is apparent from the chart 300, the TP Ratio for the interchangeable thumb assemblies 130, 200 has a value that is greater than 3.0. For the listed thumb assemblies 130, the value of the TP Ratio is within the range from a lower limit of approximately 3.3 to an upper limit of approximately 3.6. In many previous no-link type thumb assemblies, the TP Ratio values are generally smaller, and less than 3.0. This result may be expected with the implementation of the thumb actuator 134 of FIG. 4 having the additional length provided by the extension portion 162. Of course, those skilled in the art will understand that the thumb actuator 134 could be replaced in the thumb assembly 130 by a thumb actuator without an extension portion 162, but with a longer cylinder housing and/or longer piston rod. Such an arrangement of the thumb actuator may have a higher risk of buckling with the longer rod but may still be implemented.

A further design parameter may also provide an indication of the design feasibility of the retracted bracket pin to thumb power pin length BT. The Installed Thumb Optimization (ITO) Ratio is defined as follows:

$$ITO\ \text{Ratio} = \frac{BT}{B} \tag{4}$$

As indicated in equation (4), the ITO Ratio compares the retracted bracket pin to thumb power pin length BT to the bracket positioning length B. For the New Thumbs 1-5, the ITO Ratio has a value in the range having a lower limit of approximately 0.79 and an upper limit of approximately 0.81. Many prior thumb assemblies have ITO Ratios of 0.77 or less. As with the TP Ratio, the ITO Ratio shows that the thumb actuators 134 of the interchangeable thumb assemblies 130 are longer and are closer in length to the distance between the central axes of the bracket pin 154 and the nose pin 126.

While the exemplary thumb assemblies set forth in the chart 300 are no-link type thumb assemblies 130, those skilled in the art will understand that the design parameters of equations (1)-(4) have equal applicability in corresponding link-type thumb assemblies 200. In the thumb assemblies 200, the thumb length or radius T and thumb power radius P, the bracket positioning length B and the cylinder stroke length CS will be the same as the dimensions of the corresponding thumb assemblies 130. Due to the links 204, 208 connecting the thumb actuator 202 to the thumb power pin 148 as shown in FIG. 5, the cylinder retracted length CR and, correspondingly, the cylinder extended length CE will be less than in the corresponding no-link type thumb assembly 130. However, the retracted bracket pin to thumb power pin length BT will be the same as in the corresponding thumb assembly 130, and will not be equal to the cylinder retracted length CR as is the case in the no-link type thumb assemblies 130.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. An implement system for a machine having a stick member with a nose end and a mounting bracket, the implement system comprising:

a thumb pivotally connected to the nose end of the stick member by a nose pin having a nose pin central axis; and a thumb actuator operatively connected between the mounting bracket of the stick member and the thumb to move the thumb between a fully retracted position and a fully extended position, wherein a first end of the thumb actuator is pivotally connected to the mounting bracket by a bracket pin having a bracket pin central axis and a second end of the thumb actuator is pivotally connected to the thumb by a thumb power pin having a thumb power pin central axis, and wherein the implement system has a Retracted Thumb Kinematic (RTK) Factor defined as follows:

$$RTK\ \text{Factor} = \frac{B^{2.2}}{BT * P}$$

where B is a bracket positioning length from the nose pin central axis to the bracket pin central axis, BT is a thumb power pin length from the bracket pin central axis to the thumb power pin central axis when the thumb is in the fully retracted position, and P is a thumb moment arm length from the nose pin central axis to the thumb power pin central axis, with the RTK Factor having a value within a range having a lower limit of approximately 24.0 and an upper limit of approximately 28.0.

2. The implement system of claim 1, wherein the RTK Factor has a value within a range having a lower limit of approximately 24.3 and an upper limit of approximately 25.8.

3. The implement system of claim 1, comprising:

a first link having a first end pivotally connected to the stick member and second end; and a second link having a first end pivotally connected to the thumb and a second end pivotally connected to the second end of the first link, wherein the second end of the thumb actuator is pivotally coupled to the first link.

4. The implement system of claim 1, wherein the implement system has a Thumb Performance (TP) Ratio defined as follows:

$$TP\ \text{Ratio} = \frac{BT}{P}$$

with the TP Ratio having a value greater than 3.0.

5. The implement system of claim 4, wherein the TP Ratio has a value within a range having a lower limit of approximately 3.3 and an upper limit of approximately 3.6.

6. The implement system of claim 1, wherein the implement system has an Installed Thumb Optimization (ITO) Ratio defined as follows:

$$ITO\ \text{Ratio} = \frac{BT}{B}$$

with the ITO Ratio having a value greater than 0.78.

7. The implement system of claim 6, wherein the ITO Ratio has a value within a range having a lower limit of approximately 0.79 and an upper limit of approximately 0.81.

8. An implement system for a machine having a stick member with a nose end and a mounting bracket, the implement system comprising:

a thumb pivotally connected to the nose end of the stick member by a nose pin having a nose pin central axis; and a thumb actuator operatively connected between the mounting bracket of the stick member and the thumb to move the thumb between a fully retracted position and a fully extended position, wherein a first end of the thumb actuator is pivotally connected to the mounting bracket by a bracket pin having a bracket pin central axis and a second end of the thumb actuator is pivotally connected to the thumb by a thumb power pin having a thumb power pin central axis, and wherein the implement system has a Thumb Performance (TP) Ratio defined as follows:

$$TP\ \text{Ratio} = \frac{BT}{P}$$

where BT is a thumb power pin length from the bracket pin central axis to the thumb power pin central axis when the thumb is in the fully retracted position, and P is a thumb moment arm length from the nose pin central axis to the thumb power pin central axis, with the TP Ratio having a value greater than 3.0.

9. The implement system of claim 8, wherein the TP Ratio has a value within a range having a lower limit of approximately 3.3 and an upper limit of approximately 3.6.

10. The implement system of claim 8, comprising:

a first link having a first end pivotally connected to the stick member and second end; and a second link having a first end pivotally connected to the thumb and a second end pivotally connected to the second end of the first link, wherein the second end of the thumb actuator is pivotally coupled to the first link.

11. The implement system of claim 8, wherein the implement system has an Installed Thumb Optimization (ITO) Ratio defined as follows:

$$ITO \text{ Ratio} = \frac{BT}{B}$$

where B is a bracket positioning length from the nose pin central axis to the bracket pin central axis, with the ITO Ratio having a value greater than 0.78.

12. The implement system of claim 11, wherein the ITO Ratio has a value within a range having a lower limit of approximately 0.79 and an upper limit of approximately 0.81.

13. The implement system of claim 11, wherein the implement system has a Retracted Thumb Kinematic (RTK) Factor defined as follows:

$$RTK \text{ Factor} = \frac{B^{2.2}}{BT * P}$$

with the RTK Factor having a value within a range having a lower limit of approximately 24.0 and an upper limit of approximately 28.0.

14. The implement system of claim 13, wherein the RTK Factor has a value within a range having a lower limit of approximately 24.3 and an upper limit of approximately 25.8.

15. An implement system for a machine having a stick member with a nose end and a mounting bracket, the implement system comprising:

a thumb pivotally connected to the nose end of the stick member by a nose pin having a nose pin central axis; and a thumb actuator operatively connected between the mounting bracket of the stick member and the thumb to move the thumb between a fully retracted position and a fully extended position, wherein a first end of the thumb actuator is pivotally connected to the mounting bracket by a bracket pin having a bracket pin central axis and a second end of the thumb actuator is pivotally connected to the thumb by a thumb power pin having a thumb power pin central axis, and wherein the implement system has an Installed Thumb Optimization (ITO) Ratio defined as follows:

$$ITO \text{ Ratio} = \frac{BT}{B}$$

where BT is a thumb power pin length from the bracket pin central axis to the thumb power pin central axis when the thumb is in the fully retracted position, and B is a bracket positioning length from the nose pin central axis to the bracket pin central axis, with the ITO Ratio having a value greater than 0.78.

16. The implement system of claim 15, wherein the ITO Ratio has a value within a range having a lower limit of approximately 0.79 and an upper limit of approximately 0.81.

17. The implement system of claim 15, comprising:

a first link having a first end pivotally connected to the stick member and second end; and a second link having a first end pivotally connected to the thumb and a second end pivotally connected to the second end of the first link, wherein the second end of the thumb actuator is pivotally coupled to the first link.

* * * * *